US005743999A

United States Patent [19]

Kamps et al.

[11] Patent Number: 5,743,999

[45] Date of Patent: Apr. 28, 1998

[54] METHOD FOR MAKING SOFT TISSUE

[75] Inventors: Richard Joseph Kamps, Wrightstown; Janica Sue Behnke, Appleton; Fung-Jou Chen, Appleton; Bernhardt Edward Kressner, Appleton; Janice Gail Nielsen, Appleton, all of Wis.

[73] Assignee: Kimberly-Clark Worldwide, Inc., Neenah, Wis.

[21] Appl. No.: 259,824

[22] Filed: Jun. 15, 1994

Related U.S. Application Data

[63] Continuation of Ser. No. 46,789, Apr. 12, 1993, abandoned.

[51] Int. Cl.[6] ..... D21F 3/04

[52] U.S. Cl. ..... 162/113; 162/111; 162/117

[58] Field of Search ..... 162/109, 111, 162/113, 117

[56] References Cited

U.S. PATENT DOCUMENTS

| | | | |
|---|---|---|---|
| 3,301,746 | 1/1967 | Sanford et al. | 162/113 |
| 3,817,827 | 6/1974 | Benz | 162/113 |
| 4,189,344 | 2/1980 | Busker | 162/117 |
| 4,356,059 | 10/1982 | Hostetler | 162/111 |
| 4,551,199 | 11/1985 | Weldon | 162/113 |
| 4,849,054 | 7/1989 | Klowak | 162/111 |
| 4,921,034 | 5/1990 | Burgess et al. | 162/113 |
| 4,994,144 | 2/1991 | Smith et al. | 162/111 |

FOREIGN PATENT DOCUMENTS

| | | | |
|---|---|---|---|
| 2 177 856 | 11/1973 | France | D21F 11/00 |

*Primary Examiner*—Peter Chin

*Attorney, Agent, or Firm*—Gregory E. Croft

[57] ABSTRACT

Paper sheets, such as creped tissue sheets used for converting into tissue products such as facial tissue and bath tissue, can be softened with by passing the sheets through one or more fixed-gap noncompactive straining nips formed between two engraved rolls having partially-engaged small straining elements of a shape which strains the sheet in all directions. The straining treatment substantially reduces the rigidity of the tissue sheet by increasing the internal bulk without substantially reducing the tensile strength. The method provides a means for making a throughdried-like tissue sheet from a wet-pressed tissue sheet.

17 Claims, 17 Drawing Sheets

METHOD FOR MAKING SOFT TISSUE

This is a continuation application of application Ser. No. 08/046,789, filed on Apr. 12, 1993, now abandoned.

BACKGROUND OF THE INVENTION

In the commercial manufacture of tissue products such as facial tissue, bath tissue, paper towels and dinner napkins, there are essentially two different methods for making the base tissue sheet to be converted into the final tissue product form. One method is wet pressing and the other is throughdrying.

Wet pressing is the older and more common method of making facial or bath tissue. Wet pressing essentially involves mechanically pressing water out of the wet web in a pressure nip between a pressure roll and the surface of a heated, rotating Yankee dryer as the web is adhered to the Yankee surface. This wet pressing step not only dewaters the web to a consistency of about 40 weight percent, but also compacts the web and promotes a high degree of hydrogen bonding between fibers as the web is dried on the Yankee, thereby resulting in a relatively dense, stiff sheet. Creping adhesives can be used to augment adhesion of the wet web to the Yankee surface. The softness and stretch of the dried sheet is controlled during the creping step, where many of the papermaking bonds formed within the web during drying are broken by the impact of the web with the doctor blade as the sheet is dislodged from the surface of the Yankee. However, the bond breaking achieved by creping is not uniform, resulting in nonuniform softness and strength within the resulting sheet.

In the throughdrying process, dewatering to a consistency of about 25 weight percent is achieved by vacuum suction and the web is dried with minimal compaction by passing hot air through the dewatered web while the web is supported by a porous throughdrying fabric. As a result of this non-compactive drying, fewer papermaking bonds are formed as the web is dried and the resulting tissue sheet is softer than an uncreped wet-pressed sheet. The softness of the throughdried sheet can be further improved by creping, however, by adhering the dry throughdried web to a Yankee with suitable adhesives and thereafter creping the throughdried sheet. However, because the web is already dry at the point where it is adhered to the Yankee, few additional papermaking bonds are formed within the sheet at this point and hence softness is not adversely affected.

While throughdrying can generally provide a softer tissue than wet pressing, throughdrying is also significantly more expensive because of the cost of the throughdryers. The softness of wet-pressed sheets can also be improved by adding chemical debonders to the furnish to reduce the fiber bonding created during wet pressing, but the resulting softness gains are attended by a corresponding decrease in strength as defined by the strength/softness curve for the given basesheet. Hence there is a need to be able to produce very soft tissue products of throughdrying quality using conventional wet-pressing assets.

SUMMARY OF THE INVENTION

It has now been discovered that wet-pressed tissue sheets (as described above) can be significantly softened without any or significant loss of strength by passing the creped tissue sheet through one or more specially-designed straining nips in which relatively weak papermaking bonds within the sheet are broken while the stronger bonds are left intact. Breaking the weaker bonds within the sheet is manifested in a more open sheet structure which can be quantified by the increased measure of the percent void area exhibited in cross sections of the treated sheet. Unlike embossing processes, the method of this invention avoids z-direction compaction of the sheet. The result of this treatment is a softer, more drapey sheet having the same or substantially the same strength. Although it is within the scope of this invention to use this treatment to improve the softness of throughdried sheets, pulp sheets or any other webs, including nonwoven webs of synthetic fibers or mixtures of synthetic and natural fibers, the greatest benefits are obtained with wet-pressed tissue sheets because there is greater room for improvement in the product and because the process of this invention can be readily applied to existing conventional tissue machines to vastly improve the product with minimal capital investment.

Hence in one aspect, the invention resides in a method for oftening a sheet comprising passing the sheet through one or more non-compactive straining nips, each nip formed between two engraved rolls having partially-engaged intermeshing straining elements which strain the sheet in all directions, wherein the Average Percent Void Area ("APVA") of the sheet, hereinafter defined, is increased without a substantial reduction in the geometric mean tensile (GMT) strength of the sheet, hereinafter defined. In general, the APVA is a measure of the internal bulk or openness of the tissue sheet. Higher APVA values represent more flexible, softer, less dense sheets, whereas lower APVA values represent stiffer, less soft, more dense sheets. The engraved rolls used to form the straining nip, sometimes referred to as straining rolls, can be engraved steel rolls commonly used for embossing, but which differ either in terms of the pattern engraved in the rolls and/or the manner in which the rolls are operated. Engraved rubber rolls, as produced by laser engraving, can also be used, however. The nature of the rolls and their operation will be described in detail hereinafter.

In another aspect, the invention resides in a method of making a basesheet for a tissue product comprising: (a) forming a tissue web from an aqueous suspension of papermaking fibers; (b) dewatering the web; (c) drying and creping the web to form a creped tissue sheet; and (d) passing the creped tissue sheet through one or more non-compactive straining nips, each nip formed between two engraved rolls having partially-engaged intermeshing straining elements which strain the sheet in all directions, wherein the APVA of the tissue sheet is increased without a substantial reduction in the geometric mean tensile strength. Preferably the APVA is increased by the method of this invention by about 1.5 percentage points or more per 100 grams loss in GMT, preferably about 2 percentage points or more, and more preferably about 3 percentage points or more. APVA increases of from about 2 to about 5 percentage points or more are common.

In another aspect, the invention resides in a wet-pressed tissue sheet having an APVA of about 63 or greater, suitably from about 63 to about 65, and more preferably about 65 or greater. Geometric mean tensile strengths of these sheets are preferably about 400 grams or greater, more preferably about 500 grams or greater, and suitably from about 400 to about 1000 grams.

As used herein, a "sheet" is any web or sheet including without limitation, tissue sheets (defined below), paper sheets, pulp sheets, nonwovens, laminates, composites and the like.

"Pulp sheets" are pressed, dried, uncreped, heavyweight sheets of papermaking fibers generally used as a feedstock for papermaking. Pulp sheets generally have a basis weight of from about 75 to about 400 grams per square meter, more commonly from about 150 to about 200 grams per square meter. They can be in individual sheet or roll form.

As used herein, a "wet-pressed" sheet means any wetlaid sheet which is partially dewatered by pressing the sheet in a nip, including pressing the sheet with a pressure roll between a felt and a Yankee dryer.

As used herein, a "tissue sheet" is a dry sheet of papermaking fibers having a dryer basis weight of from about 5 to about 70 grams per square meter per ply, preferably from about 10 to about 40 grams per square meter per ply, and more preferably from about 20 to about 30 grams per square meter per ply. The tissue sheets can be layered or unlayered, single- or multiple-ply, and are preferably manufactured by wet pressing or throughdrying tissue making processes as are well known in the papermaking art. Tissue sheets are preferably creped, especially for wet-pressed tissue sheets, and are particularly useful for making facial tissue, bath tissue, dinner napkins, paper towels, and the like.

The geometric mean tensile (GMT) strength is the square root of the product of the machine direction tensile strength and the cross-machine direction tensile strength of the tissue sheet. Tensile strengths can be determined in accordance with TAPPI test method T 494 om-88 using flat gripping surfaces (4.1.1, Note 3), a specimen width of 3 inches (or 76.2 millimeters), a jaw separation of 2 inches (or 50.8 millimeters), a crosshead speed of 10 inches (or 254 millimeters) per minute. The units of geometric mean tensile strength are grams per 3 inches (or 76.2 millimeters) of sample width, but for convenience are herein reported simply as "grams".

A feature of the method of this invention is the use of non-compactive straining nip(s). The method of this invention essentially provides a large number of very small gentle non-compactive compactive defections of the sheet in the z-direction without tearing the sheet. This multiple localized gentle flexing of the sheet, referred to herein as micro-straining, causes the weaker bonds of the sheet to break, thereby improving the flexibility of the sheet, while leaving most of the stronger bonds intact, thereby preserving tensile strength and providing uniform debonding of the sheet. The caliper or thickness of the micro-strained sheet, as measured under load, is substantially unaffected and may actually decrease slightly due to the increased softness or conformability. Accordingly roll bulk or sheet stack bulk as measured under load is not increased or at least not substantially increased.

On the other hand, conventional embossing, in contrast with micro-straining, is generally used for the explicit purpose of generating increased external bulk for a collection of embossed tissue sheets, such as a roll or stack of tissues. The increase in external bulk is attained by compacting or densifying portions of the sheet in order to impart a pattern of permanent sheet deflections (embossments). However, compaction of the sheet reduces the internal bulk of the sheet, increases the rigidity of the sheet and the abrasiveness of the sheet, and thereby decreases the sheet softness. In addition, formation of these embossments also substantially weakens the sheet. Therefore increases in softness attended by lesser decreases in strength is one characteristic which distinguishes the micro-straining method of this invention from conventional embossing.

An oftentimes distinguishing characteristic of the method of this invention compared to conventional embossing can be the lack of visually distinct permanent embossments remaining in the sheet after micro-straining as compared to embossing. Even when embossing with a very fine pattern of small embossing elements, a distinct embossing pattern still remains visible to the naked eye. Such embossed sheets, when viewed in cross-section, typically have distinct compressed areas. This is not the case with micro-strained products, which have substantially uniform thickness. While there can be a discernable pattern, it is an indistinct, soft, gentle pattern that does not contribute to increased bulk under load because the deflections are very flexible. Of course, if an embossing pattern is desireable in the final product, the micro-strained sheet of this invention can subsequently or, less preferably, previously embossed to achieve the desired embossing pattern.

Roll engagement, which is the distance the male element of one roll penetrates the female opening of the second roll, determines the amount of z-direction deflection of the sheet. The extent of z-direction deflection cannot exceed the point of rupture of the sheet. Short of that limitation, z-direction deflection will vary dependent on the caliper, basis weight, strength and stretch of the sheet. All things being equal, sheets having higher stretch require greater z-direction deflection to achieve the same softness gains attainable for sheets having lower stretch. Also, thicker sheets, such as pulp sheets, will require greater z-direction deflection than thinner sheets. For most tissue sheets, the z-directional deflection, as measured by the degree of roll engagement, will preferably be in the range of from about 0.02 millimeter to about 0.3 millimeter, more preferably from about 0.05 to about 0.2 millimeter. For pulp sheets, the degree of roll engagement will preferably be in the range of from about 0.1 to about 1 millimeter, more preferably from about 0.2 to about 0.6 millimeter. It must be kept in mind, however, that increasing roll engagement will also decrease roll nip accommodation, which is the minimum distance between the surfaces of two intermeshing rolls in a fixed gap nip. In order to avoid compaction of the sheet, the roll nip accommodation must be greater than or equal to the caliper of the sheet at its compacted elastic limit. Lesser nip accommodations will irreversibly compact the sheet to a caliper from which the sheet cannot rebound. It is preferable that the nip accommodation be greater than or equal to the caliper of the sheet.

Depending on the sheet properties desired, it can be advantageous to progressively increase the level of engagement of the straining elements with each successive pass through the straining nip. It is believed that the strength loss in obtaining a given APVA can be minimized by using a plurality of straining nips having successively increasing engagement.

The size of the straining elements is closely related to the thickness of the sheet and hence the extent of z-directional deflection of the sheet desired, as well as the number of passes through a straining nip to which the sheet will be exposed. For applications involving tissue sheets, the height or depth of the male and female straining elements, which can be the same or different, can preferably be from about 0.05 millimeter to about 3 millimeters, more specifically from about 0.1 to about 1.5 millimeter, and still more specifically from about 0.1 to about 1 millimeter. For pulp sheets, the height or depth of the male and female straining elements can preferably be from about 1 to about 4 millimeters, more preferably from about 2 to about 3 millimeters.

The shape of the straining elements can vary widely, but it is preferable that the male elements be distinct knobs or bumps, as opposed to continuous ridges or valleys, in order to provide straining of the sheet in all directions as the sheet passes through the straining nip. Although the straining elements can be round or polygonal as viewed normal to the surface of the straining rolls, they can also have an elongated shape, such as an oval or rectangular (preferably with rounded corners), which can provide directionally differential straining. In addition or alternatively, the number of straining elements per lineal inch in the axial direction of the straining roll (corresponding to the cross-machine direction of the sheet) can be equal to, greater than, or less than the number of elements per lineal inch in the circumferential direction of the straining roll (corresponding to the machine direction of the sheet), in order to further provide directionally differential straining of the sheet. Because of the inherently greater stretch of tissue sheets in the machine direction, it is preferable to have more straining elements per inch in the circumferential direction of the rolls to more effectively strain the sheet in the machine direction.

The density of the straining element pattern can be defined as the number of straining elements per square centimeter. Preferably, for tissue sheets, the density of the straining elements can be from about 1 to about 100 elements per square centimeter, more preferably from about 30 to about 80 elements per square centimeter. For pulp sheets, the density of the straining elements can preferably be from about 3 to about 30 elements per square centimeter, more preferably from about 5 to about 10 elements per square centimeter.

The number of passes or times the sheet is passed through a straining nip in accordance with this invention can be one or more, preferably two or more, and more preferably three or more. The advantage of using multiple passes is to obtain more uniform and total coverage of the sheet. The number of passes will in part depend on the element size and density, the extent of partial engagement of the elements, and the incoming sheet characteristics. In general, more passes with larger fixed gaps is preferable to fewer passes with smaller fixed gaps.

The optimum straining process for a given basesheet results in the greatest increase in softness (APVA) for the lowest strength loss from the original basesheet. Finding the optimum process set-up is accomplished by trial and error, initially using a single pass through the straining nip over a range of roll engagements. This will determine the roll engagement that produces the highest softness at the lowest strength loss for the first pass. This point becomes the starting point for the second pass. Again, the second pass through the straining nip is performed over a range of roll engagements to determine the roll engagement that produces the highest softness at the lowest strength loss for the second pass. This process can be repeated over numerous passes resulting in generating the highest softness gain for the lowest strength loss from the original base sheet. Roll engagements can stay the same, increase, or decrease with each consecutive pass or successive pass. The straining roll pattern design can also stay the same or be different with each successive pass.

As previously disclosed, the increase in softness (as measured by the increase in APVA) resulting from the practice of this invention is greater than the increase in softness attained by simply lowering the strength according to the strength/softness curve associated with the given basesheet. As will be demonstrated in connection with the discussion of the specific examples illustrated in the Drawing, the softness improvements attained in accordance with the method of this invention are quantified as having an increase in the APVA of about 1.5 or greater per 100 grams of GMT strength loss. This compares to a softness increase attainable by following the typical strength softness curve of only about 1 APVA unit per 100 grams of GMT strength loss.

DETAILED DESCRIPTION OF THE DRAWING

Figure 1:
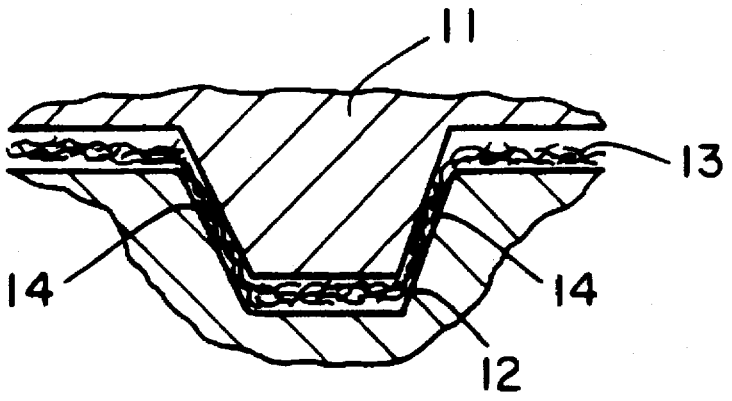
FIG. 1 (PRIOR ART)
FIG. 1 is a schematic cross-sectional view of a tissue sheet in an embossing nip between two matched steel embossing rolls, illustrating the high degree of straining or shearing along the region of the embossing element sidewalls.

Referring to the Drawing, the invention will be further described in detail.

FIG. 1 illustrates a prior art matched steel embossing nip in which the tissue sheet is permanently deformed to provide a pattern of fixed embossments. Shown is the male embossing element 11 and the matching female element 12, with the tissue sheet 13 being embossed in between. In this embossing process, the tissue sheet experiences a great amount of compaction, straining and shearing in the area 14 between the male and female element sidewalls, causing a substantial weakening of the tissue sheet and permanent deformation in the shape of the embossing elements. Permanent deformation can also be due to deflection of the sheet beyond its elastic limits, which is not the case with the microstraining method of this invention. The degree of engagement of the male and female elements depends on the nature of the tissue sheet and the desired bulk increase, but in general the tissue sheet will be deflected at least about 0.012 inch (or about 0.305 millimeter), which can be significantly greater than that required for purposes of this invention. Of course, other factors as described herein, such as element size, shape and density can also contribute to permanent deformation of the sheet.

Figure 2:
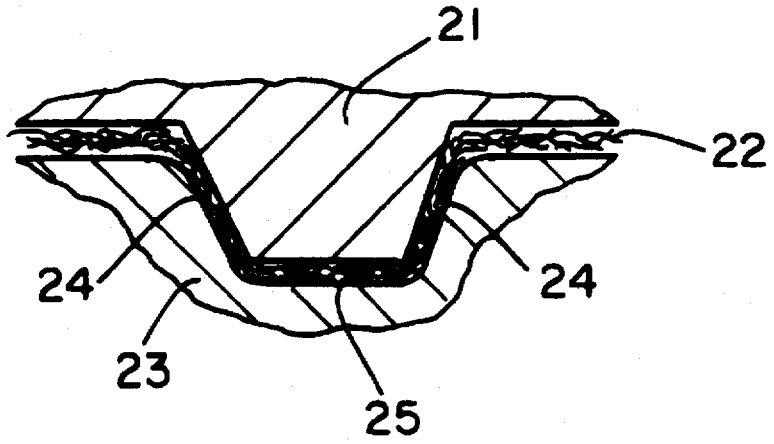
FIG. 2 (PRIOR ART)
FIG. 2 is a schematic cross-sectional view of a tissue sheet in an embossing nip between a steel embossing roll and a rubber backup roll, illustrating the high degree of compaction and shearing of the sheet.

FIG. 2 illustrates another typical prior art embossing nip in which a steel male embossing element 21 is used to emboss a tissue sheet 22 with a rubber back-up roll 23. With this type of embossing, the tissue sheet is not only compacted and sheared in the sidewall regions 24, but it is subject to substantial compression in the region 25 corresponding to the bottom of the male element. The degree to which the tissue sheet is deflected is generally about 0.01 inch or greater (or about 0.25 millimeter). As with the matched steel embossing process described above, steel/rubber embossing provides increased external sheet bulk properties with a significant amount of internal sheet compaction and loss of tensile strength.

Figure 3A:
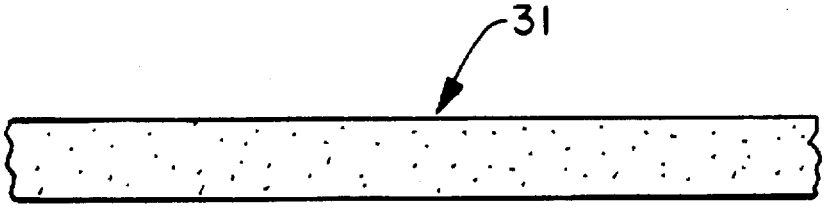
FIGS. 3A, 3B and 3C are schematic cross-sectional views of a tissue sheet before, during and after passing through a straining nip in accordance with this invention.
Figure 3B:
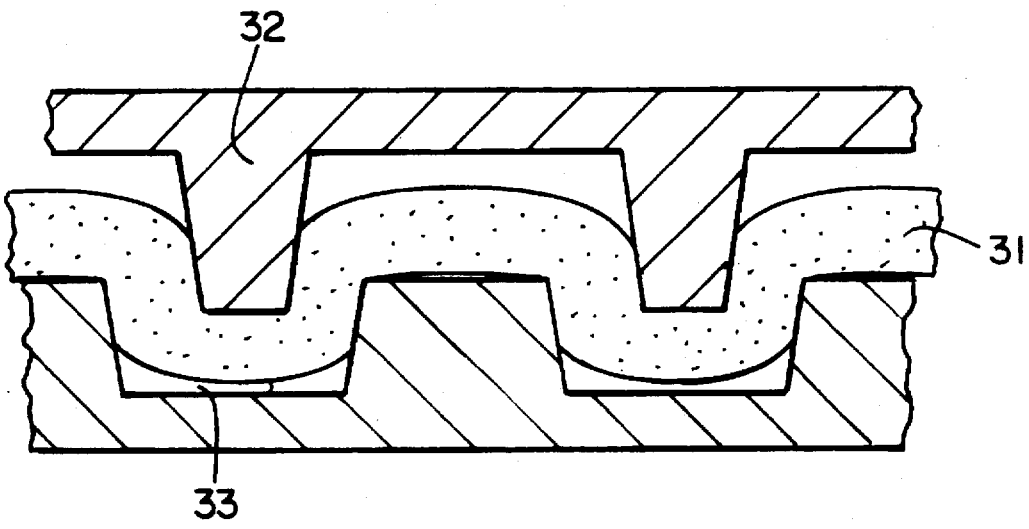
Figure 3C:
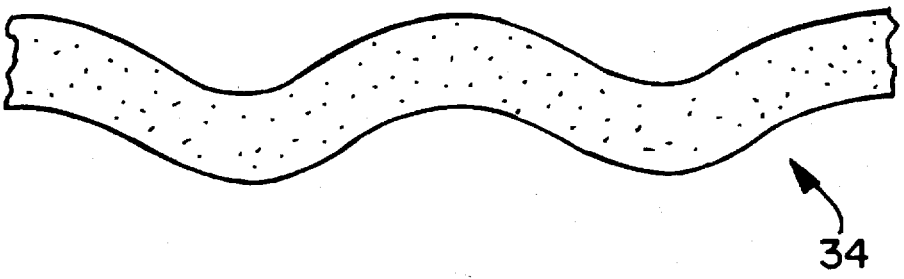

FIGS. 3A, 3B and 3C schematically illustrate the action of a straining nip on a tissue sheet in accordance with this invention. Shown in FIG. 3A is a tissue sheet 31 as it might look prior to being subjected to the method of this invention. FIG. 3B illustrates the same tissue sheet as it passes through a straining nip in accordance with this invention, in which the tissue sheet 31 is strained between a male straining element 32 and a corresponding intermeshing female void element 33. As shown, the male and female elements need not be matched (mirror images of each other), although they can be matched provided the elements are sufficiently tapered to ensure adequate accommodation between the elements is maintained. Using unmatched, yet intermeshing, elements as shown provides greater flexibility in the operation of the straining nip by making sidewall compression of the sheet independent of the level of element engagement. Note that the degree of engagement of the elements is relatively slight providing only enough flexure of the web to strain the web and thereby rupture some of the weaker bonds.

FIG. 3C illustrates the strained web 34 as it might look after leaving the straining nip. There may or may not be a noticeable pattern remaining, depending on the extent to which the web is strained. However, there will be a slight increase in non-compressed caliper or thickness of the web as shown, which can also be reflected in the measure of the APVA.

Figure 3D:
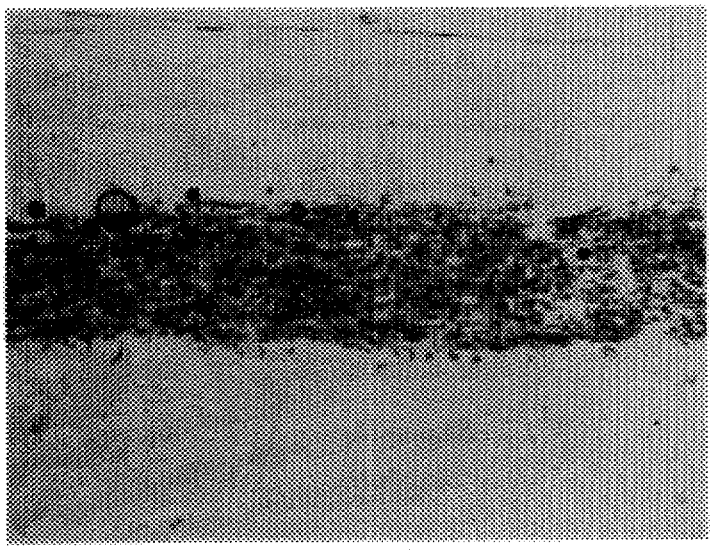
FIGS. 3D and 3E are cross-sectional photographs of a pulp sheet before and after, respectively, passing through multiple straining nips in accordance with this invention.

FIG. 3D is a cross-sectional photograph of a pulp sheet prior to microstraining. The basis weight of the pulp sheet was 196 grams per square meter and the sheet caliper was 0.060 centimeters.

Figure 3E:
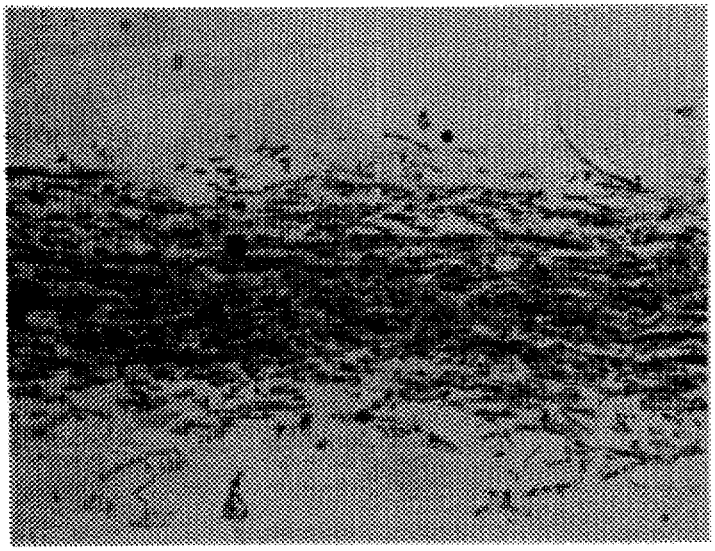

FIG. 3E is a cross-sectional photograph of the pulp sheet of FIG. 3D after being subjected to 54 passes through a microstraining nip in accordance with this invention. Note the increase in internal void area between fibers and the increase in non-compressed caliper.

Figure 4A:
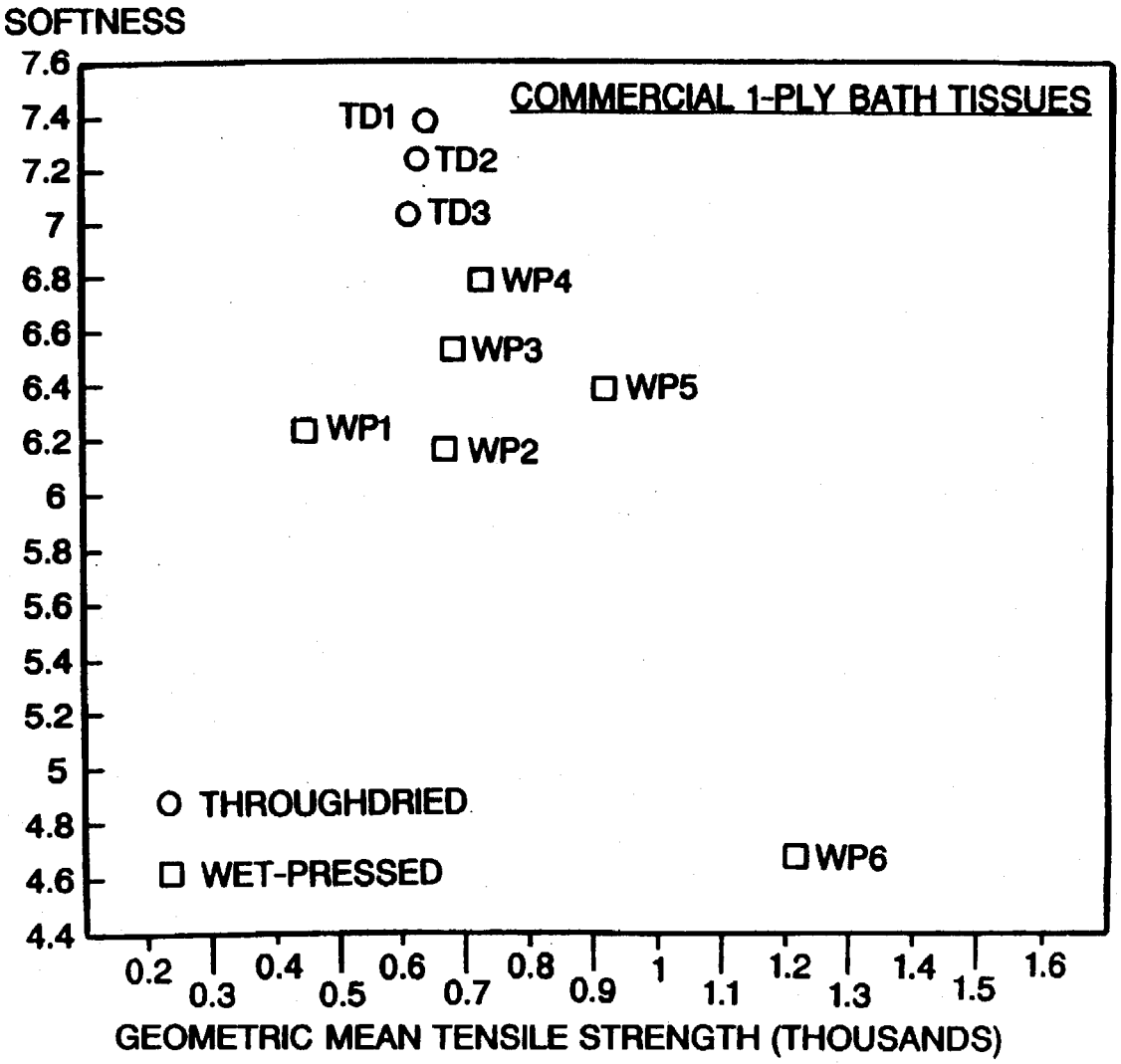
FIG. 4A is a plot of softness versus geometric mean tensile strength for commercially available I-ply bath tissues, illustrating the generally superior softness of throughdried tissues as compared to wet-pressed tissues.

FIG. 4A is a plot of softness versus geometric mean tensile strength for some commercially available one-ply bath tissue products. The data points labelled "WP" are products made by wet-pressing and the data points labelled "TD" are products made by throughdrying. Softness was determined using a trained sensory panel which rated the softness of the tissues on a scale of 1 to 15. As is apparent from the plot, throughdried products are in general softer than wet-pressed products, which appear to have a softness ceiling of about 6.8.

Figure 4B:
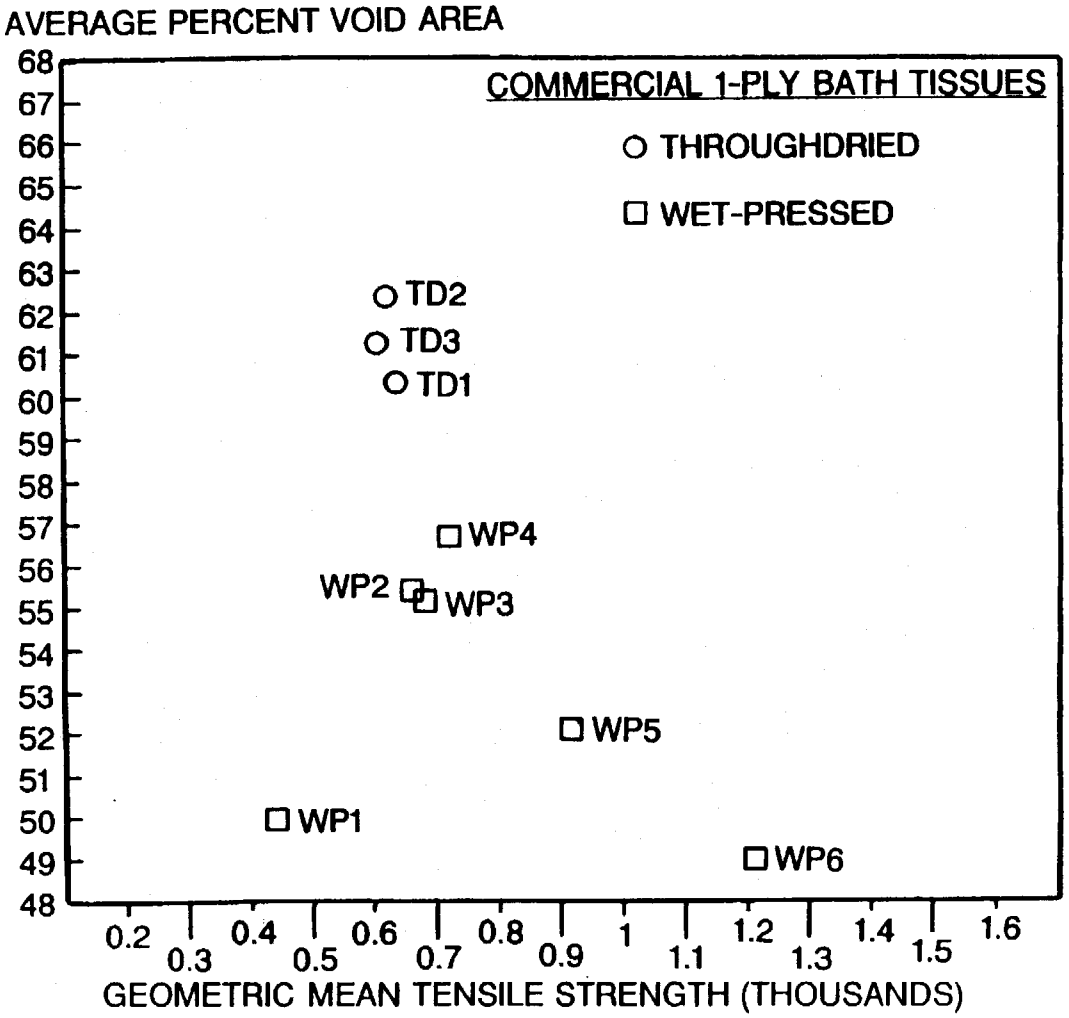
FIG. 4B is a plot similar to that of FIG. 4, but replacing softness with the APVA to illustrate the correlation of softness with the APVA.

FIG. 4B is a plot similar to that of FIG. 4 for the same products, but substituting APVA for softness on the ordinate to illustrate that APVA can be an objective measure of softness. This plot more clearly distinguishes wet-pressed single-ply bath tissues from throughdried single-ply bath tissues, the wet-pressed tissues topping out at an APVA value of about 57 percent. It should be noted that one or two APVA points is a significant noticeable change in softness.

Figure 5:
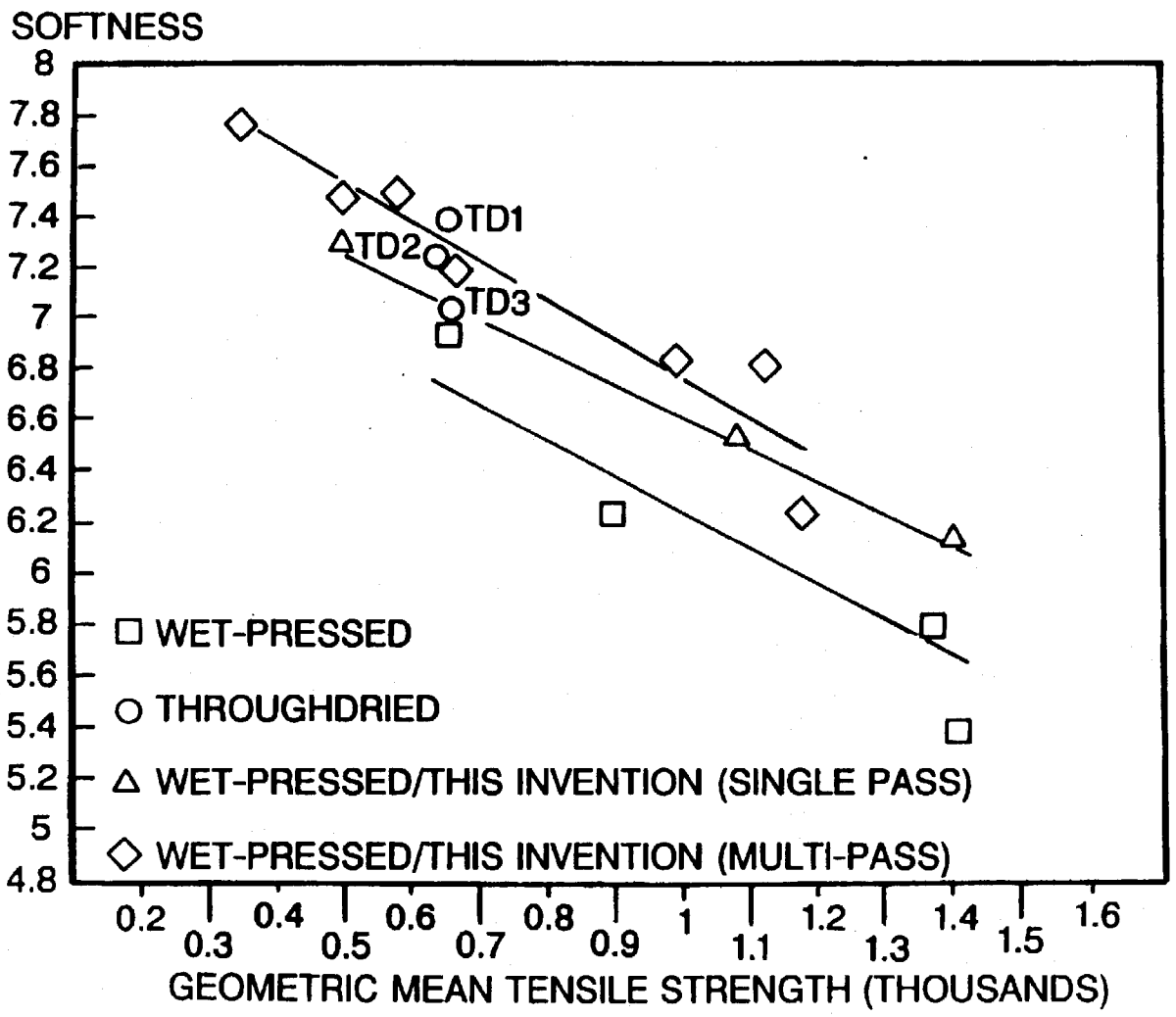
FIG. 5 is a plot of strength versus softness for several different tissue products, illustrating the normal strength/softness curve (line) for such products, as well as illustrating the improvements attained by subjecting a wet-pressed tissue sheet to the method of this invention using one pass and multiple passes through a straining nip.

FIG. 5 is a plot of softness versus geometric mean tensile strength for four different single-ply tissue products. The throughdried products are plotted only for reference to place perspective on the improvements imparted by the method of this invention. All three lines drawn (for the three wet-pressed products only) are linear progressions of the data points defining the strength/softness curve for each basesheet. The bottom line represents the strength/softness curve for a single-ply wet-pressed tissue made at four different strength levels using different levels of a dry strength additive. The middle line represents the strength/softness curve for the same tissues, but which have been micro-strained in accordance with this invention using one pass through a straining nip having male and female rolls as earlier described in detail and a level of engagement of 0.2 millimeter. The top line is the corresponding strength/softness curve for the same product, but which in some cases has been subjected to 3 passes and in other cases subjected to 5 passes at a 0.1 millimeter level of engagement. As shown, the method of this invention displaces the strength/softness curve of the basesheet upwardly, thereby providing softer products at equivalent strengths. In this instance the wet-pressed sheets were improved in softness to the levels of the throughdried sheets at equivalent strengths.

Figure 6:
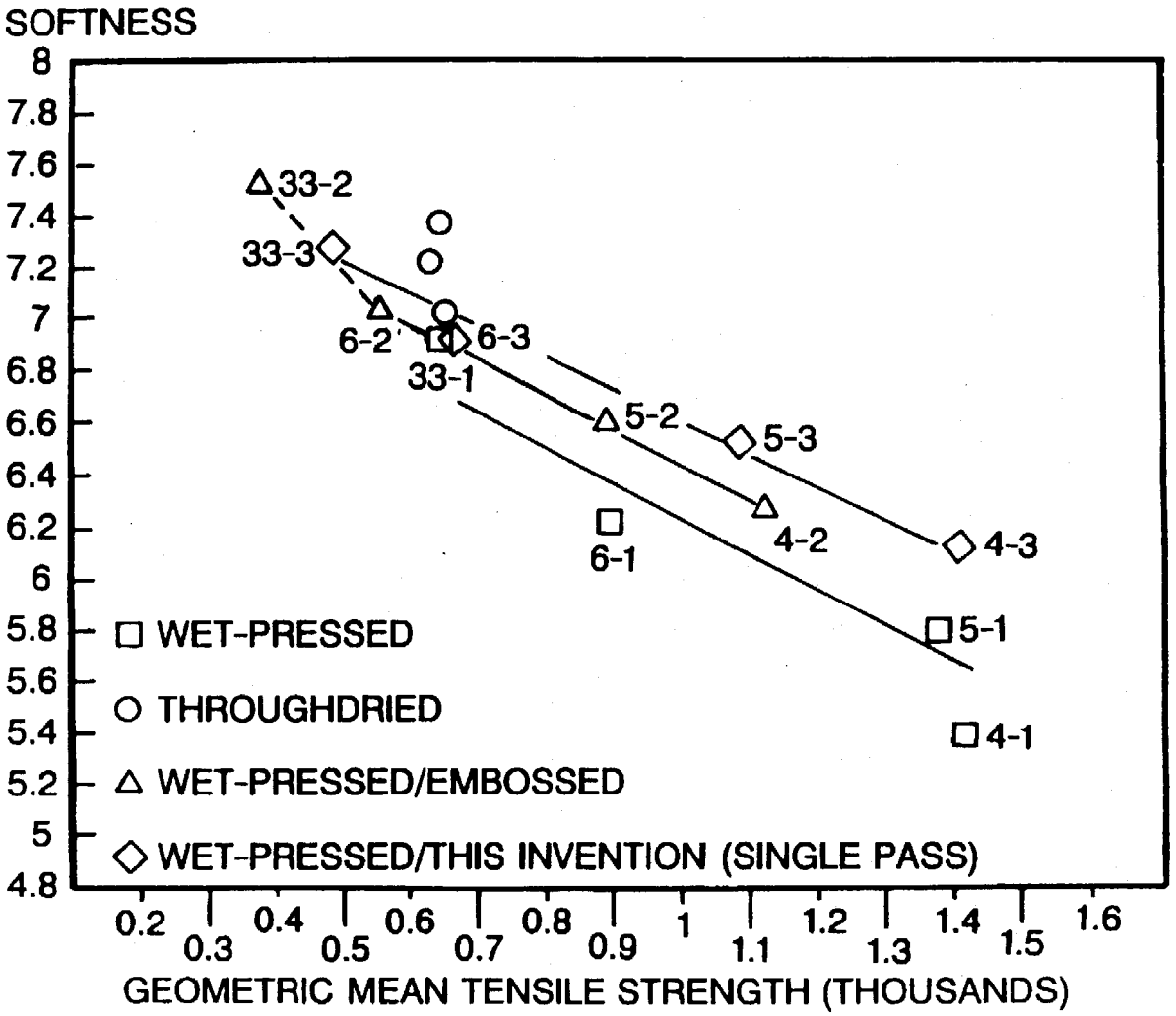
FIG. 6 is a plot similar to that of FIG. 5, primarily illustrating the method of this invention as applied to a wet-pressed tissue sheet compared to subjecting the same tissue sheet to an embossing operation with the same element pattern.

FIG. 6 is a plot similar to that of FIG. 5, but illustrating the effect on the strength/softness curve of one pass using the method of this invention compared to embossing the same web using the same rolls and same elements. In effect, the level of engagement was increased from 0.2 millimeter (microstraining) to 0.3 millimeter, resulting in compaction of the web at the bottom of the female element (embossing). The bottom line is the strength/softness curve for a conventional wet-pressed single-ply sheet. The middle line represents the strength/softness curve for the same sheet which has been embossed. Data point 33-2 was not included in the regression analysis because at low strengths softness values begin to converge and it is difficult for panel members to discern differences in softness for weak sheets. The top line represents the strength/softness curve for the original wet-pressed sheet which has been micro-strained with a single pass in accordance with this invention, illustrating further improvement over the control and the embossed sheet.

Figure 7A:
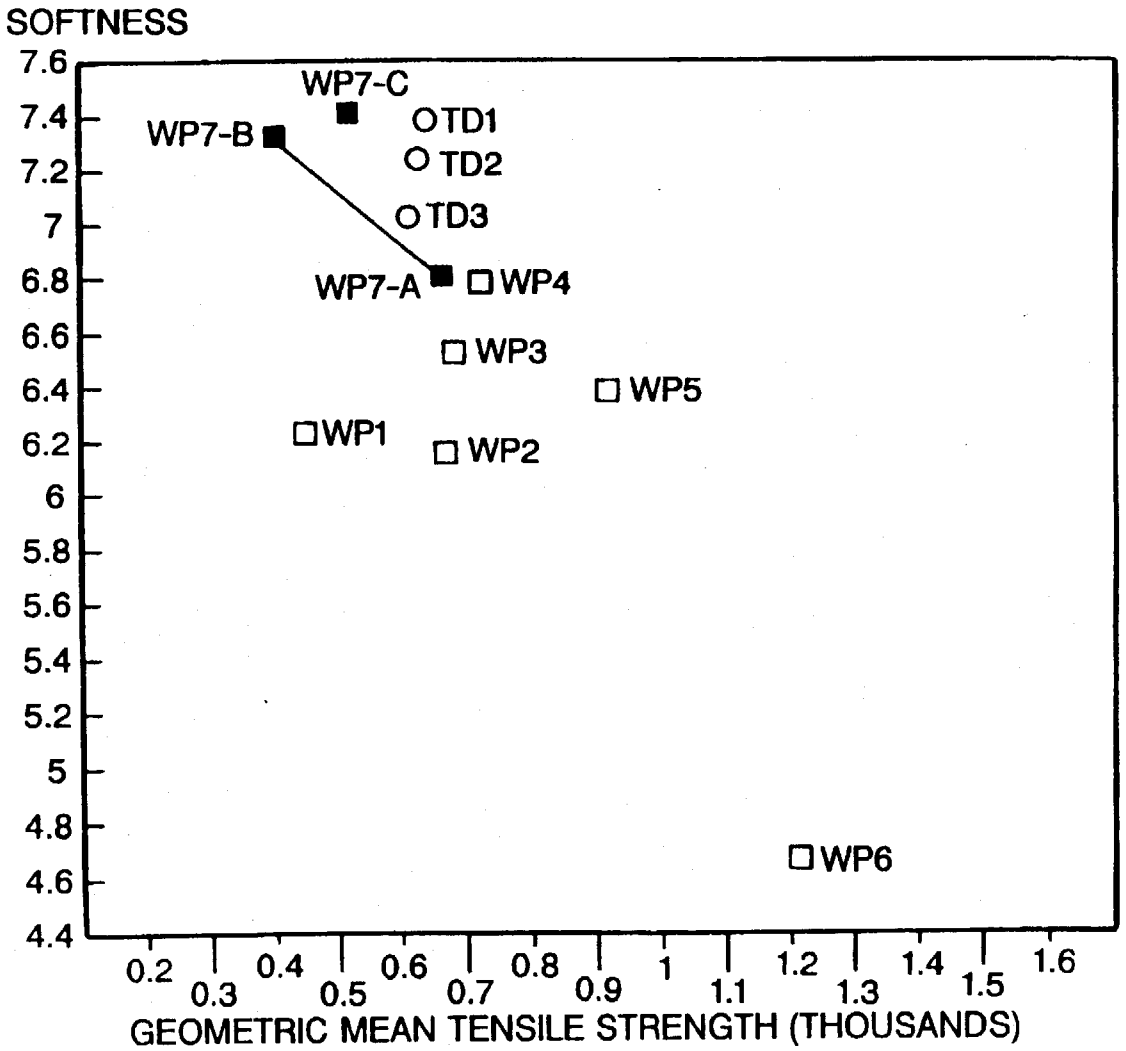
FIG. 7A is a plot of softness versus geometric mean tensile strength for a single-ply tissue which has been made at two different strength levels illustrate the softness/strength curve for that product, and further illustrating the softness improvement attained by straining the higher strength product in accordance with this invention to elevate the softness into the range of the throughdried products.

FIG. 7A is a plot similar to that of FIG. 4A, but containing additional points WP7-A, WP7-B and WP7-C. Points WP7-A and WP7-B represent single-ply, wet-pressed, blended furnish tissues made at two different strength levels to establish the strength/softness curve for that particular basesheet. Point WP7-C was obtained by subjecting the tissue of Point WP7-A to three passes through a straining nip in accordance with this invention to produce the product represented by point WP7-C, illustrating the improvement in softness. The male and female rolls of the straining nip were as previously described in detail. The level of engagement was 0.05 millimeter for the first pass, 0.075 millimeter for the second pass, and 0.1 millimeter for the third pass.

Figure 7B:
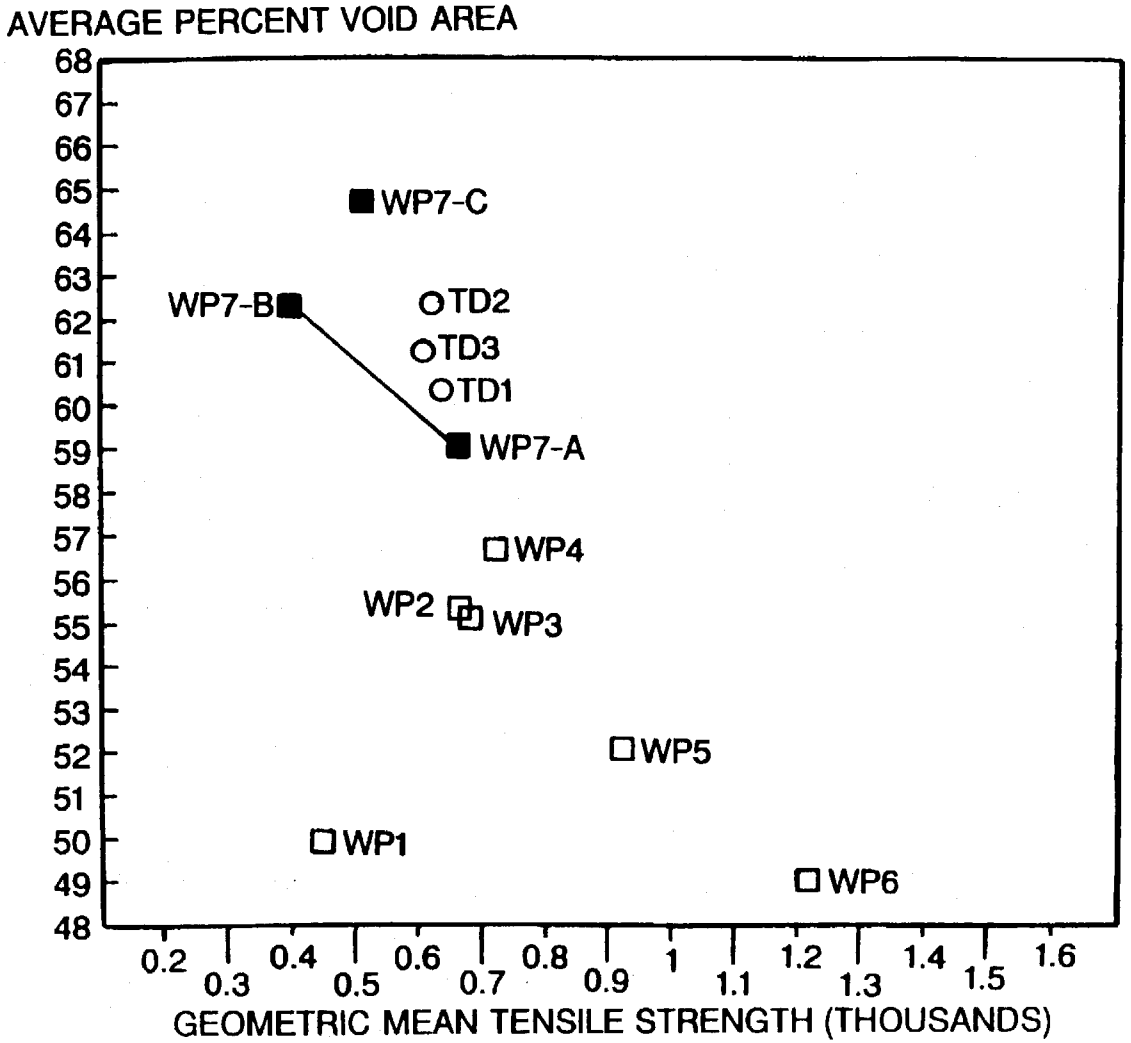
FIG. 7B is a plot similar to FIG. 7A for the same tissue samples, but substituting the APVA for softness on the ordinate, illustrating the correlation of softness and the APVA.

FIG. 7B is a plot similar to that of FIG. 7A, except the APVA replaced softness on the ordinate, illustrating the same effect of this invention on APVA as with softness.

Figure 8A:
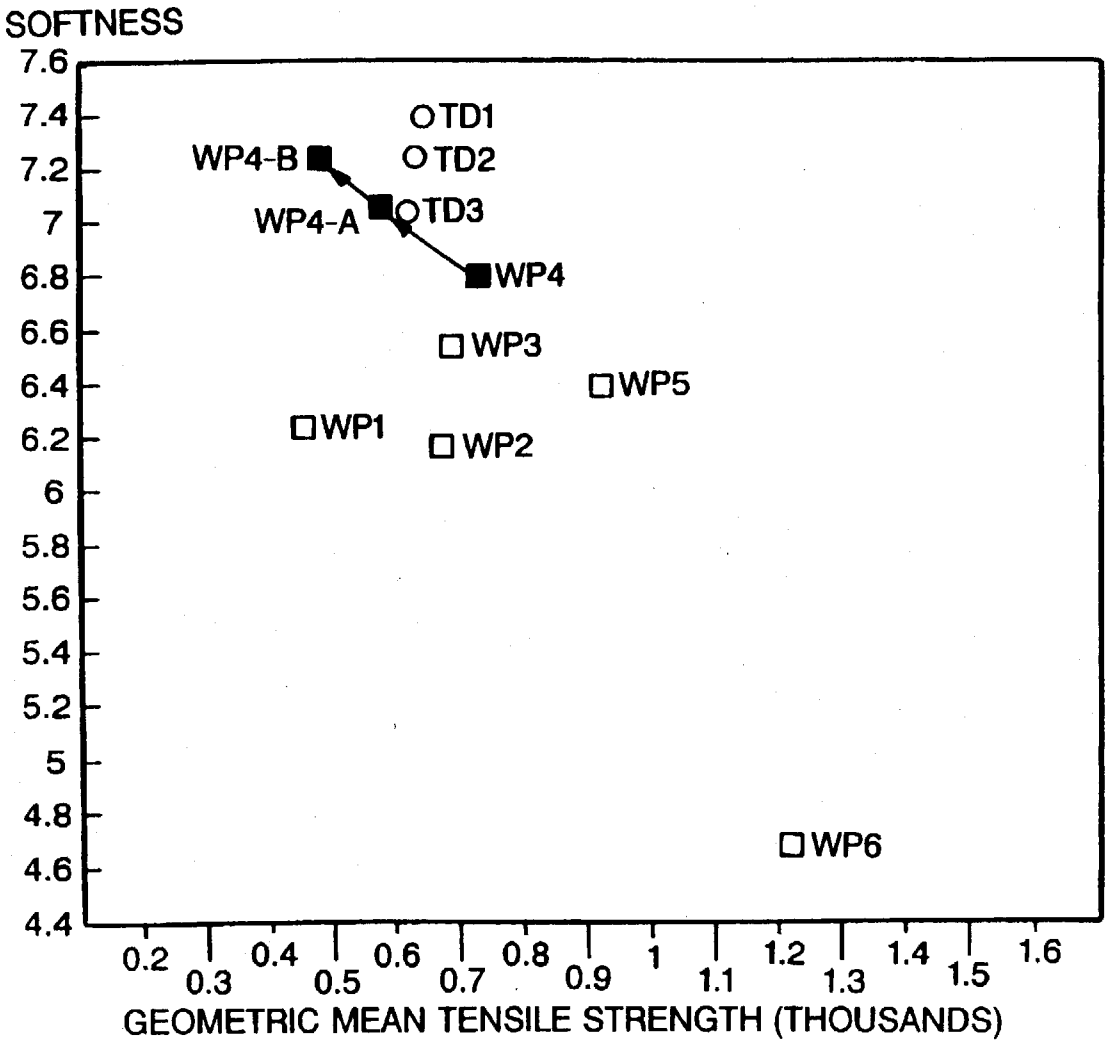
FIG. 8A is a plot similar to FIG. 7A, but illustrating the incremental improvements on the softness of a single-ply wet-pressed tissue sheet by first subjecting the tissue sheet to six micro-straining passes and thereafter subjecting the same-sheet to four additional passes (total of 10).

FIG. 8A is a plot similar to that of FIG. 7A, in which commercial single-ply wet-pressed bath tissue sheet represented by point WP4 was subjected to six passes of micro-straining in accordance with this invention (WP4-A) using the same straining rolls described above with a level of roll engagement of 0.15 millimeter and thereafter subjected to four additional passes of micro-straining at a roll engagement level of 0.15 millimeter (WP4-B). This data illustrates the increasing softness improvements imparted to the product by increasing the number of passes through the straining nip.

Figure 8B:
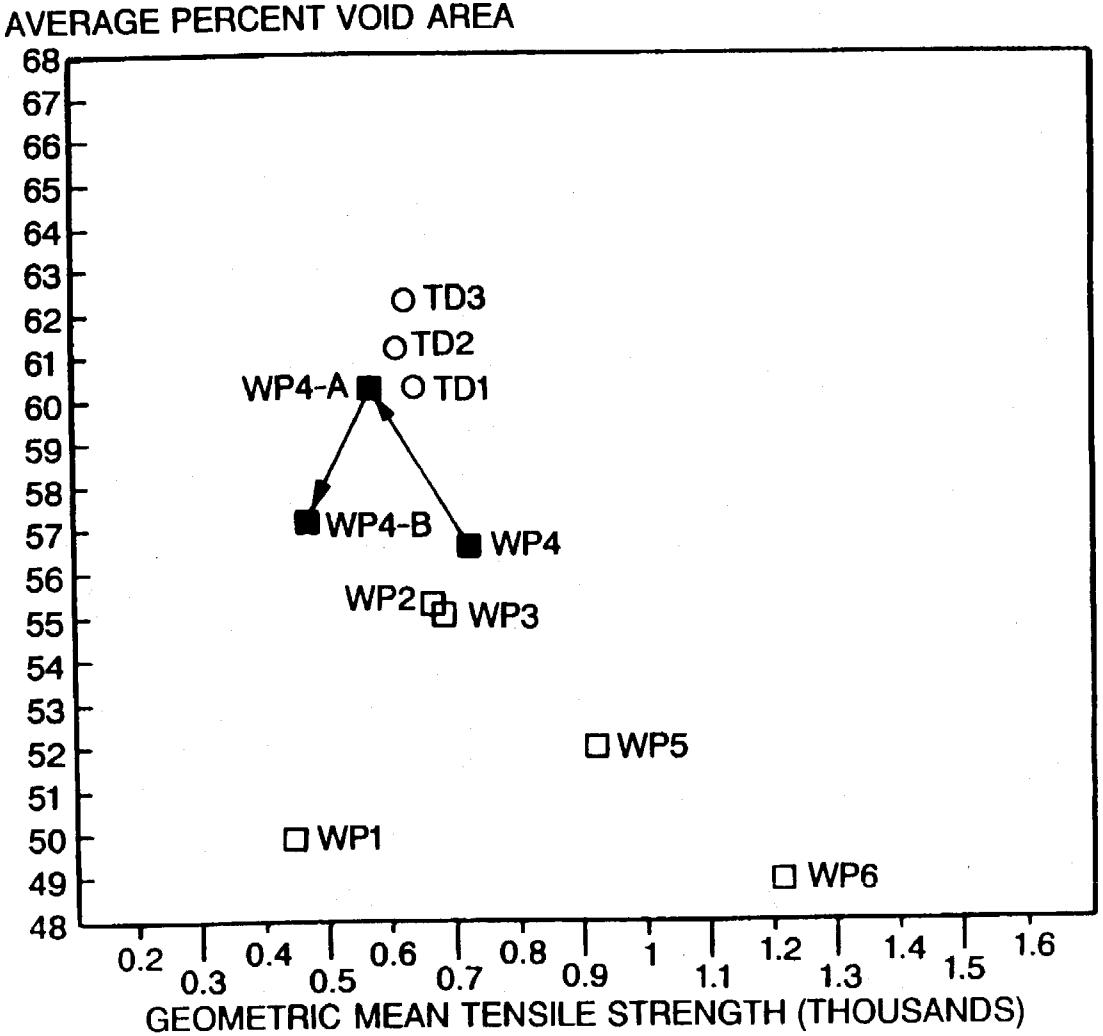
FIG. 8B is a plot similar to FIG. 8A for the same sample, but substituting the APVA for softness on the ordinate, illustrating a drop in APVA which may occur after many passes.

FIG. 8B is a plot similar to that of FIG. 8A, but in which the APVA replaces softness on the ordinate. Interestingly, the APVA dropped significantly in going from six passes to ten passes, illustrating that the internal bulk can collapse if the product is overworked, thereby decreasing the strength of the fiber-to-fiber structure within the web. Notwithstanding, the softness continued to improve, indicating that, like the sensory panel, the APVA also is not always an accurate indication of softness differences at low GMT strengths of about 400 grams and below.

Figure 9A:
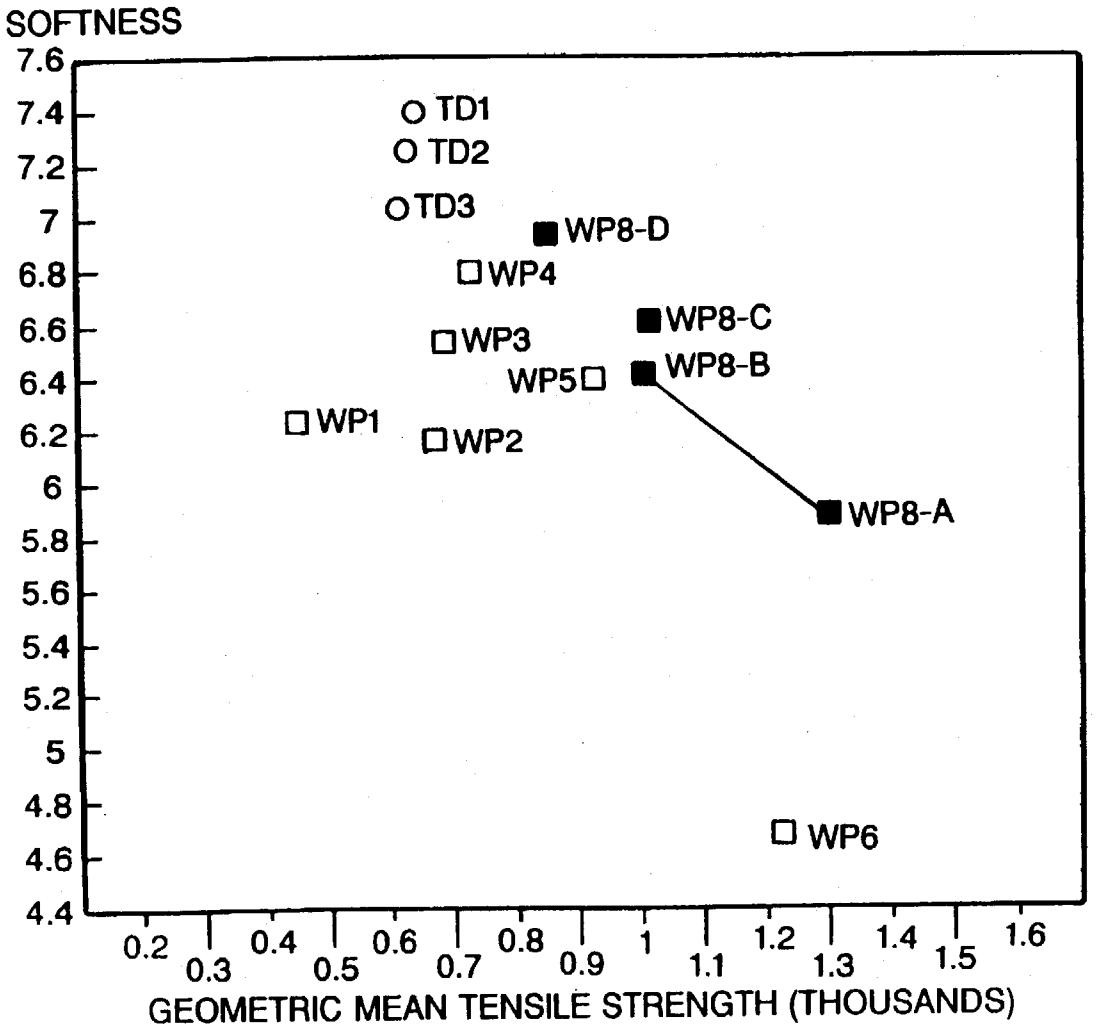
FIG. 9A is a plot similar to FIG. 7A, illustrating the softness improvements for two wet-pressed tissue sheets on the same strength/softness curve after one pass in accordance with this invention.

FIG. 9A is a plot similar to FIG. 7A, but with four added data points WP8-A, WP8-B, WP8-C and WP8-D. Points WP8-A and WP8-B are single-ply wet-pressed tissue sheets which are identical, except for strength differences created by different levels of furnish refining, and provide a basis for drawing the strength/softness line as shown. Point WP8-C represents the result of three passes of the sheet represented by point WP8-A through a straining nip as described previously in accordance with this invention, using level of roll engagement of 0.1 millimeter for each pass. Similarly, point WP8-D represents three passes of the sheet represented by point WP8-8 through the same straining nip at the same level of roll engagement in accordance with this invention. As shown, the softness of the tissue sheets was not only increased in both instances, but the micro-strained products of this invention were elevated above the existing strength/softness curve.

Figure 9B:
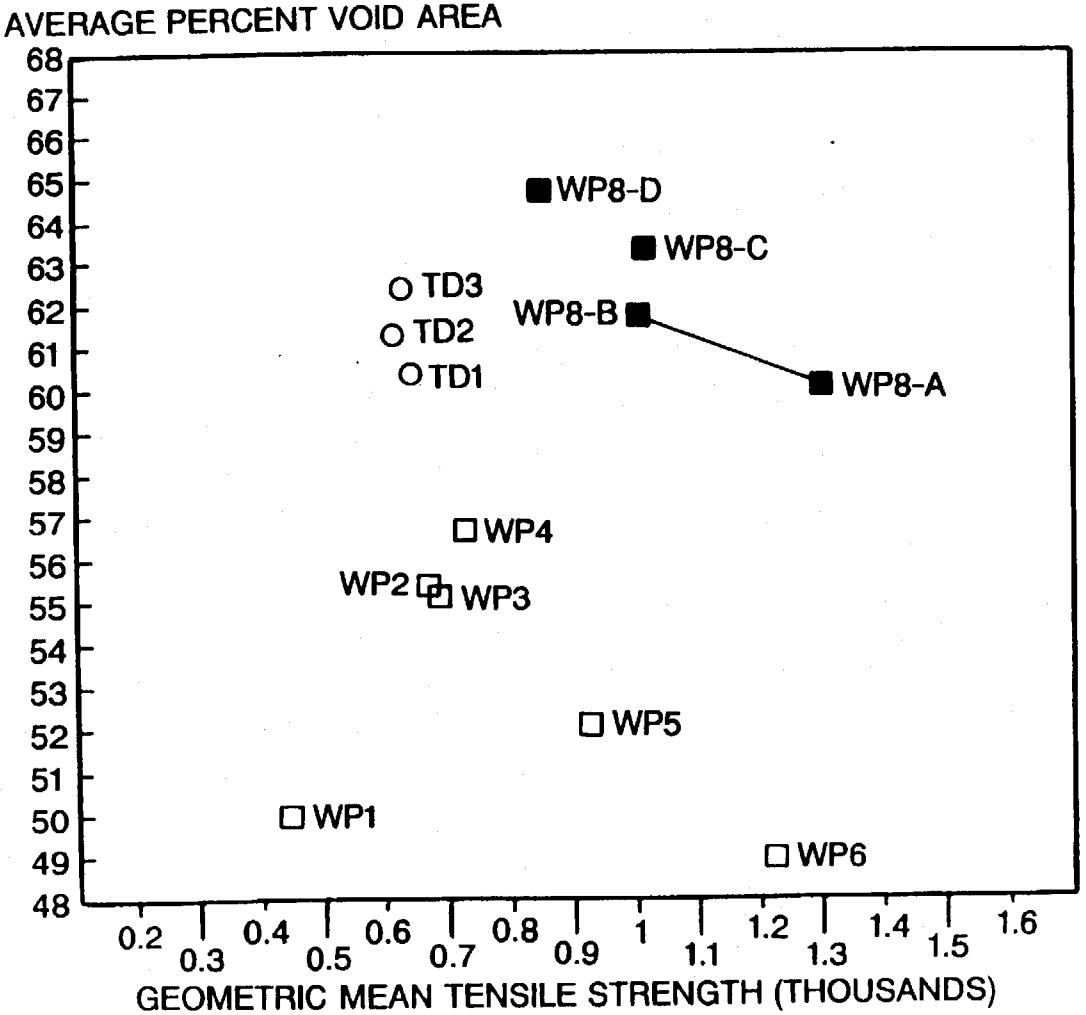
FIG. 9B is a plot similar to that of FIG. 9A using the same samples, but substituting the APVA for softness on the ordinate.

FIG. 9B is similar to the plot of FIG. 9A, except softness was replaced on the ordinate with the APVA, illustrating the same correlation.

Figure 10:
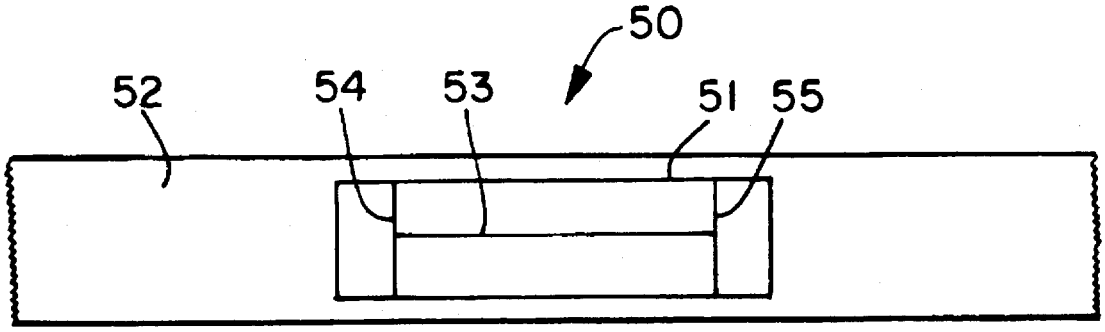
FIGS. 10, 11, 12, 13A, B, 14 and 15 pertain to the method for determining the Average Percent Void Area of a sample.

FIGS. 10–15 pertain to the method for determining the APVA, which is described in detail below. Briefly, FIG. 10 illustrates a plan view of a specimen sandwich 50 consisting of three tissue specimens 51 sandwiched between two transparent tapes 52. Also shown is a razor cut 53 which is parallel to the machine direction of the specimen, and two scissors cuts 54 and 55 which are perpendicular to the machine direction cut.

Figure 11:
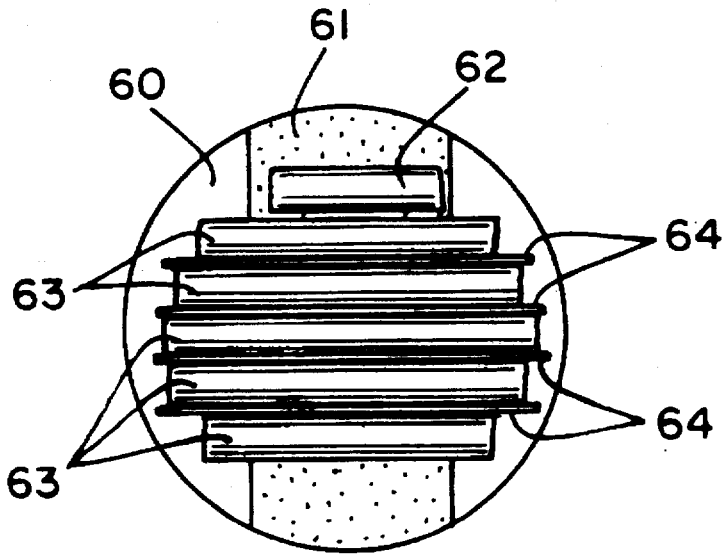

FIG. 11 illustrates a metal stub which has been prepared for sputter coating. Shown is the metal stub 60, a two-sided tape 61, a short carbon rod 62, five long carbon rods 63, and four specimens 64 standing on edge.

Figure 12:
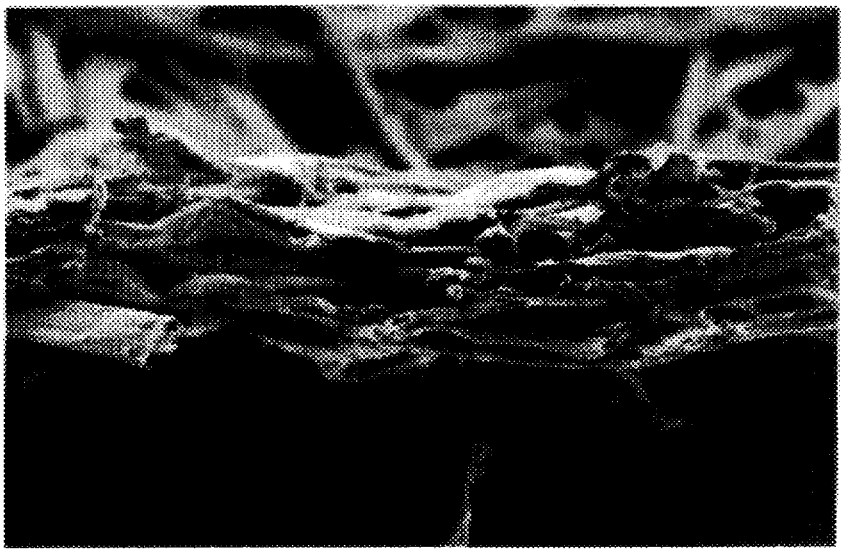

FIG. 12 shows a typical secondary electron cross-sectional photograph of a sputter coated tissue sheet using Polaroid® 54 film.

Figure 13A:
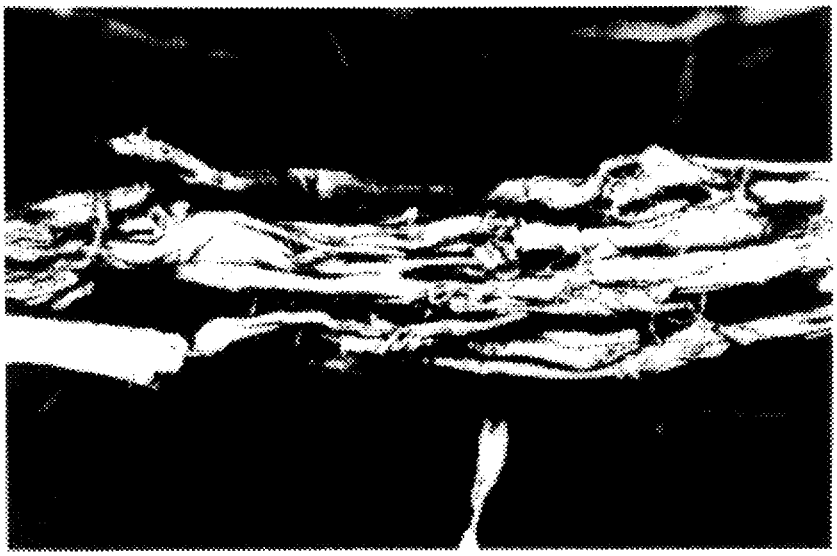

FIG. 13A shows a cross-sectional photograph of the same tissue sheet as shown in FIG. 12, but using Polaroid 51 film. Note the greater black and white contrast between the spaces and the fibers.

Figure 13B:
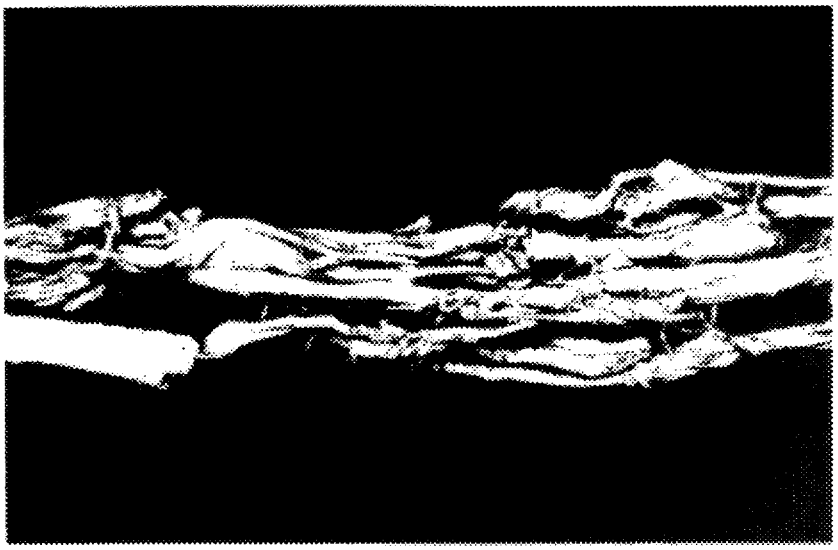

FIG. 13B is the same photograph as that of FIG. 13A, except the extraneous fiber portions not connected or in the plane of the cross-section have been blacked out in preparation for image analysis as described herein.

Figure 14:
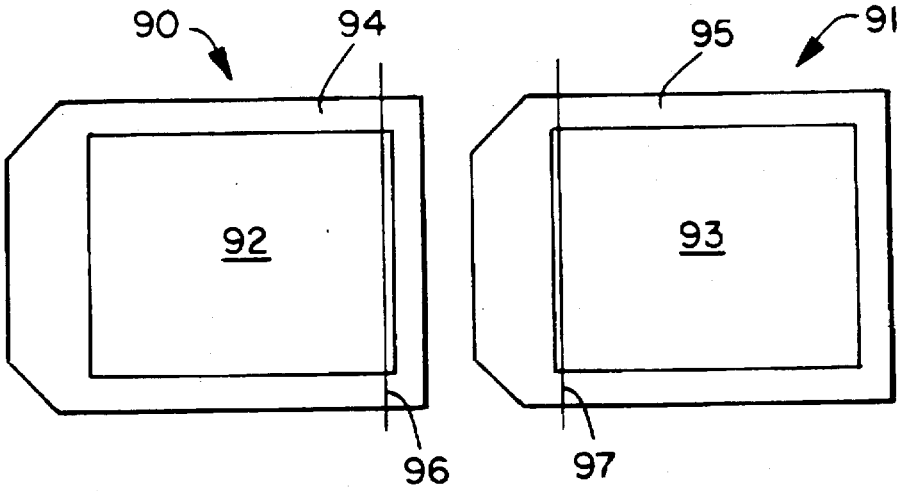

FIG. 14 shows two Scanning Electron Microscope (SEM) specimen photographs 90 and 91 (approximately ½ scale), illustrating how the photographs are trimmed to assemble a montage in preparation for image analysis. Shown are the photo images 92 and 93, the white border or framing 94 and 95, and the cutting lines 96 and 97.

Figure 15:
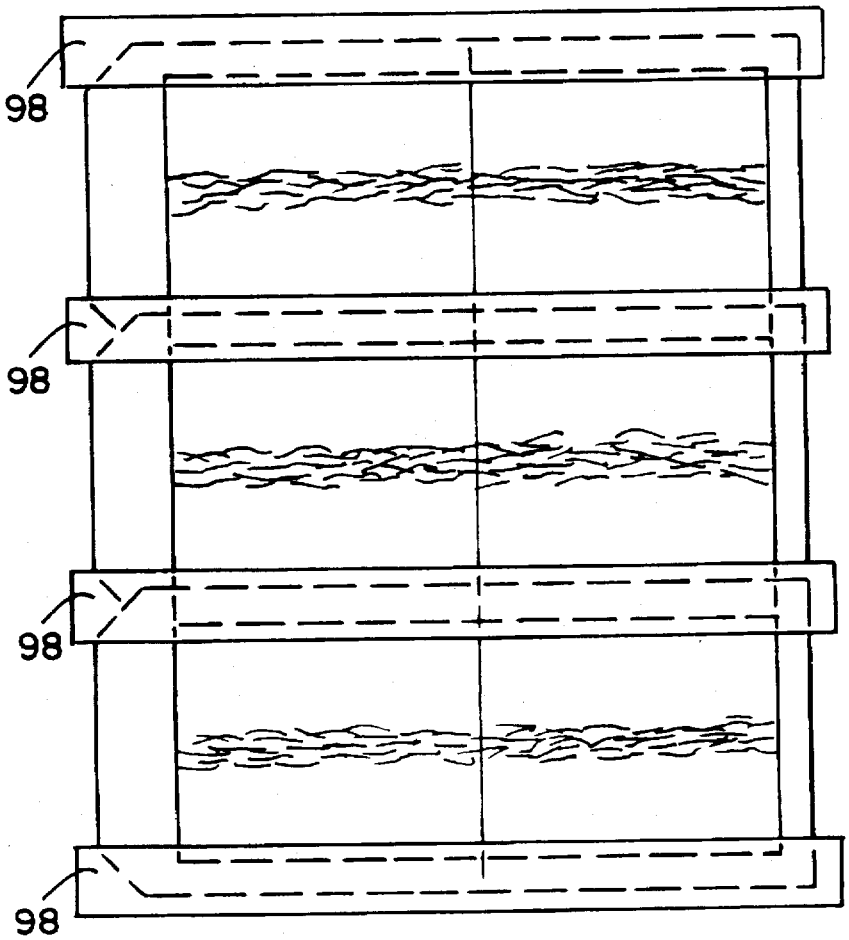

FIG. 15 shows a montage of six photographs (approximately ½ scale) in which the white borders of the photographs are covered by four strips of black construction paper 98.

Average Percent Void Area (APVA)

The method for determining the APVA is described below in numerical stepwise sequence, referring to FIGS. 10–15 from time to time. In general, the method involves taking several representative cross-sections of a tissue sample, photographing the fiber network of the cross-sections with a scanning electron microscope (SEM), and quantifying the spaces between fibers in the plane of the cross-section by image analysis. The average percent area of the photographs within the tissue boundaries not occupied by fibers is the APVA for the sample.

A. Specimen Sandwiches

1. Samples should be chosen randomly from available material. If the material is multi-ply, only a single ply is tested. Samples should be selected from the same ply position. The same surface is designated as the upper surface and samples are stacked with the same surface upwards. Samples should be kept at 30° C. and 50 percent relative humidity throughout testing.

2. Determine the machine direction of the sample, if it has one. The cross-machine direction of the sample is not tested. The cross-section will be cut such that the cut edge to be analyzed is parallel to the machine direction.

3. Place about five inches (127 millimeters) of tape (such as 3M Scotch™ Transparent Tape 600 UPC 021200-06943, ¾ inch (19.05 millimeters) width, on a working surface such that the adhesive side is uppermost. (The tape type should not shatter in liquid nitrogen).

4. Cut three ⅝ inch (or 15.87 millimeters) wide by about 2" (or 50.8 millimeters) long specimens from the sample such that the long dimension is parallel to the machine direction.

5. Place the specimens on the tape in an aligned stack such that the borders of the specimens are within the tape borders (see FIG. 10). Specimens which adhere to the tape will not be usable.

6. Place another length of tape of about 5 inches (or 127 millimeters) on top of the stack of specimens with the adhesive side towards the specimens and parallel to the first tape.

7. Mark on the upper surface of the tape which is the upper surface of the specimen.

8. Make twelve specimen sandwiches. One photo will be taken for each specimen.

B. Liquid Nitrogen Sample Cutting

Liquid nitrogen is used to freeze the specimens. Liquid nitrogen is dispensed into a container which holds the liquid nitrogen and allows the specimen sandwich to be cut with a razor blade while submerged. A VISE GRIP™ pliers can hold the razor blade while long tongs secure and hold the specimen sandwich. The container is a shallow rigid foam box with a metal plate in the bottom for use as a cutting surface.

1. Place the specimen sandwich in a container which has enough liquid nitrogen to cover the specimen. Also place the razor blade in the container to adjust to temperature before cutting. A new razor blade must be used for each sandwich to be cut.

2. Grip the razor blade with the pliers and align the cutting edge length with the length of the specimen such that the razor blade will make a cut that is parallel with the machine direction. The cut is made in the middle of the specimen. (See FIG. 10).

3. The razor blade must be held perpendicular to the surface of the specimen sandwich. The razor blade should be pushed downward completely through the specimen sandwich so that all layers are cleanly cut.

4. Remove the specimen sandwich from the liquid nitrogen.

C. Metal Stub Preparation

1. The metal stubs' dimensions are dictated by the parameters of the SEM. For the SEM described below, those dimensions are about 22.75 millimeters in diameter and about 9.3 millimeters thick.

2. Label back/bottom of stub with the specimen name.

3. Place a length of two-sided tape (3M Scotch™ Double-Coated Tape, Linerless 665, ½ inch [or about 12.7 millimeters] wide) across the diameter of the stub. (See FIG. 11), 4. Place about a ¼" (or about 6.35 millimeters) length of ⅛ inch (or about 3.17 millimeters) diameter carbon rod (manufacturer: Ted Pella, Inc., Redding, Calif., ⅛" [or 3.17 millimeters] diameter by 12-inch [or 304.8 millimeters] length, Cat. #61-12) at one end of the tape within the edges of the stub such that its length is perpendicular to the length of the tape. This marks the top of the stub and the upper surface of the specimen.

5. Place a longer rod below the short rod. The length of the rod should not extend beyond the edge of the stub and should be approximately the length of the specimen.

6. Cut the specimen sandwich perpendicular to the razor cut at the ends of the razor cut (see FIG. 10).

7. Remove the inner specimen and place standing up next to (and touching) the carbon rod such that its length is parallel to the rod's length and its razor cut edge is uppermost, The upper surface of the specimen should face the small carbon rod. 8. Place another carbon rod approximately the length of the specimen next to the specimen such that it is touching the specimen. Again, the rod should not extend beyond the disk edges.

9. Repeat specimen, rod, specimen, rod until the metal stub is filled with four specimens. Three stubs will be used for the procedure.

D. Sputter Coating the Specimen

1. The specimen is sputter coated with gold (Baizar's Union Model SCD 040 was used). The exact method will depend on the sputter coater used.

2. Place the sample mounted on the stub in the center of the sputter coater such that the height of the sample edge is about in the middle of the vacuum chamber, which is about 1¼ inches (or 31.75 millimeters) from the metal disk, 3. The vacuum chamber arm is lowered.

4. Turn the water on.

5. Open the argon cylinder valve.

6. Turn the sputter coater on.

7. Press the SPUTTERING button twice. Set the time using SET and FAST buttons. Three minutes will allow the specimen to be coated without over-coating (which could cause a false thickness) or under coating (which could cause flaring).

8. Press the STOP button once so it is flashing. Press the TENSION button at this time. The reading should be 15–20 volts. Hold the TENSION button down and press CURRENT UP and hold. After about a ten-second delay, the reading will increase. Set to approximately 170–190 volts. The current will not increase unless the STOP button is flashing.

9. Release the TENSION and CURRENT UP buttons as you turn the switch on the arm to the green dot to open the window. The current should read about 30 to 40 milliamps.

10. Press the START button.

11. When completed, close the window on the arm and turn the unit off. Turn off the water and argon. Allow the unit to vent before the specimen is removed.

E. Photographing with the SEM (JEOL, 35C, distributed by Japanese Electro Optical Laboratories, Inc. located in Boston, Mass.). A clear, sharp image is needed. Several variables known to those skilled in the art of microscopy must be properly adjusted to produce such an image. These variables include voltage, probe current, F-stop, working distance, magnification, focus and BSE Image wave form. The BSE wave form must be adjusted up to and slightly beyond the reference limit lines in order to obtain proper black-&-white contrast in the image.

These variables are adjusted to their optimum to produce the clear, sharp image necessary and individual adjustments are dependent upon the particular SEM being used. The SEM should have a thermatic source (tungsten or Lab 6) which allows large beam current and stable emission. SEMs which use field emission or which do not have a solid state back scatter detector are not suitable.

1. Load the stub such that the specimen's length is perpendicular to the tilt direction and lowered as far as possible into the holder so that the edge is just above the holder. Scan rotation may be necessary depending on the SEM used.

2. Adjust the working distance (39 millimeters was used). The specimen should fill about ⅓ of the photo area, not including the mask area. (For tissue sheets, a magnification of 100× was used.)

3. Use the tilt angle of the SEM unit to show the very edge of the specimen with as little background fibers as possible. Do not select areas that have long fibers that extend past the frame of the photo.

4. One photomicrograph is taken using normal film (POLAROID 54) for gray levels for comparison. The F-stop may vary. The areas selected should be representative and not include long fibers that extend beyond the vertical edge of the viewing field.

5. Without moving the view, take one photomicrograph using back scatter electrons with high contrast film (51 Polaroid). The F-stop may vary. A sharp, clear image is needed. After the photomicrographs are developed, a black permanent marker is used to black out background fibers that are out of focus and are not on the edge of the specimen. These can be selected by comparing the photomicrograph to the gray level photomicrograph of Step 4 above. (See FIGS. 12 and 13.)

6. A total of twelve photomicrographs are taken to represent different areas of the specimens; one photomicrograph is taken of each specimen.

7. A protective coating is applied to the photo on 51 film.

F. Image Analysis of SEM Photos

1. The 12 photos are arranged into two montages. Six photos are used in each montage. Make two stacks of six photos each, and cut the white framing off the left side of one and the white framing off the right side of the remaining stack without disturbing the photos. (See FIG. 14.)

2. Then, taking one photo from each stack, place cut edges together and tape together with the tape on the back of the photo (3M Highland™ Tape, ¾ inch [or 19.05 millimeters]). No extraneous white of the background should show at the cut, butted edges.

3. Arrange the photos with a small overlap from top to bottom as shown in FIG. 15.

4. Turn on the image analyzer (Quantimet 970, Cambridge Instruments, Deerfield, Ill.). Use a 50 mm. El-Nikkor lens with C-mount adaptor (Nikon, Garden City, N.Y.) on the camera and a working distance of about 12 inches (305 millimeters). The working distance will vary to obtain a sharp clear image on the monitor and the photo. Make sure the printer is on line.

5. Load the program (described below).

6. Calibrate the system for the photo magnification (which will generate the calibration values indicated by "x.xxxx" in the program listed below), set shading correction with white photo surface (undeveloped x-ray film), and initialize stage (12 inches by 12 inches open frame motor-driven stage (auto stage by Design Components, Inc., Franklin, Mass.)) with step size of 25 microns per step.

7. Load one of the two photo montages under a glass plate supported on the stage after strips of black construction paper are placed over the white edges of the photos. The strips are ¾ inch wide (18.9 millimeter) and 11 inches long (279 millimeters) and are placed as in FIG. 15 so that they do not cover the image in the photo. The montage is illuminated with four 150 watt, 120 volt GE reflector flood lamps positioned with two lamps positioned at an angle of about 300 on each side of the montage at a distance of about 21 inches (533 millimeters) from the focus point on the montage.

8. Adjust the white level to 1.0 and the sensitivity to about 3.0 (between 2 and 4) for the scanner using a variable voltage tranasformer on the flood lamps.

9. Run the program. The program selects twelve fields of view: two per photomicrograph.

10. Repeat at the pause with the second montage after completion of twelve fields of view on the first montage.

11. A printout will give the Average Percent Void Area.

G. Computer Program.

```
Enter specimen identity
Scanner (No. 2 Chalnicon LV = 0.00 SENS = 1.64 PAUSE)
Load Shading Corrector (pattern - OFOSU3)
Calibrate User Specified (Calibration Value = x.xxxx microns per pixel)
        (PAUSE)
CALL STANDARD
TOTDEBOND: = 0
For SAMPLE = 1 to 2
Stage Scan (                    X        Y
            scan origin         10000.0  10000.0
            field size          16500.0  11000.0
            no. of fields       3        4        )
Detect 2D (Lighter than 32 PAUSE)
For FIELD
Scanner (No. 2 Chalnicon AUTO-SENSITIVITY LV = 0.00)
Live Frame is Standard Live Frame
Detect 2D (Lighter than 32)
Amend (OPEN by 1)
Measure field - Parameters into array FIELD
RAWAREA: = FIELD AREA
Amend (CLOSE by 20)
Image Transfer from Binary B (FILL HOLES) to Binary Output
Measure field - Parameters into array FIELD
FILLAREA: = FIELD AREA
PERCDEBON: = 100, * ([FILLAREA - RAWAREA) / FILLAREA)
TOTDEBOND: = TOTDEBOND + PERCEDEBON
Stage Step
Next FIELD
Pause
Next
FIELDNUM: = FIELDNUM * (SAMPLE - 1)
Print "  "
Print "NUMBER OF FIELDS *", FIELDNUM
Print "  "
Print "AVERAGE PERCENT VOID AREA =",
TOTDEBOND/FIELDNUM
Print "  "
For LOOPCOUNT = 1 to 7
Print "  "
Next
End of Program
```

EXAMPLES

Example 1 (Straining Nip Roll Design—Tissue Sheets)

A specific straining nip roll design useful for straining tissue sheets having a caliper of about 0.2 millimeter as described in connection with FIGS. 5 through 9B herein includes two engraved rubber rolls having partially engaged intermeshing straining elements, the male roll having elongated protruding elements or knobs and the female roll having corresponding holes or voids of greater area than the male elements (as viewed normal to the plane of the surface of the roll). The male elements had a height of 0.76 millimeter, a length of 1.52 millimeter, and a width of 0.508 millimeters, hence having a length-to-width ratio of 3:1. The major axes of the elements were oriented at an angle of 65° relative to the circumferential direction of the roll (machine direction of the tissue sheet). There were an average of about 0.5 elements per millimeter in the axial direction of the roll and an average of about 1.1 elements per millimeter in the circumferential direction of the roll, resulting in an element density of 57 elements per square centimeter of roll surface. The female roll in the nip contained corresponding voids positioned to receive the male elements and having a depth of 0.81 millimeter, a length of 2.03 millimeters and a width of 1.02 millimeters. The voids were correspondingly oriented with their major axes at an angle of 65° relative to the circumferential direction of the roll. The land area between the voids was 0.15 millimeter. When the two rolls are intermeshing, the size difference between the larger voids of the female roll and the smaller elements of the male roll allows for 0.25 millimeter accommodation in all directions of the plane of the sheet. As previously mentioned, as long as the accommodation is greater than the caliper of the sheet, or at least greater than the elastic limit of the compressed sheet, no densification of the sheet will occur in the straining nip.

Example 2 (Multiple Straining Nips)

A tissue sheet having a basis weight of 24.5 grams per square meter and a caliper of 0.2 millimeter was passed through three consecutive straining nips, each as described in Example 1. The first straining nip was run with a fixed gap nip having a roll engagement of 0.05 millimeters, the second straining nip was run with a fixed gap nip having a roll engagement of 0.075 millimeter, and the third straining nip was run with a fixed gap nip having a roll engagement of 0.10 millimeter. The increase in APVA was from 59.1 to 64.9. The net loss of GMT strength was about 160 grams.

Example 3 (Straining Nip Roll Design—Pulp Sheets)

A straining roll nip found useful for microstraining pulp sheets, which had a caliper of about 0.060 centimeters, consisted of a matched steel pair of male and female rolls, the male roll having male elements with a height of 2.54 millimeters, a length of 4 millimeters, and a width of 1.0 millimeter, hence having a length-to-width ratio of 4:1. The elements were oriented with the major axis of the elements parallel to the axial direction of the roll. There were an average of 0.13 male elements per millimeter in the axial direction of the roll and an average of 0.5 male elements per millimeter in the circumferential direction of the roll, resulting in an element density of 6.2 elements per square centimeter. The female roll had corresponding voids of the same dimensions and orientation. The pulp sheet was microstrained with 50 passes at a roll engagement of 0.50 millimeter, and thereafter subjected to 4 passes at a roll engagement of 0.25 millimeter. (See FIGS. 3D and 3E.) The extensional stiffness of the resulting treated pulp sheet was reduced to about 5–7 percent of its original stiffness. Specifically, the machine direction stiffness was reduced from 265,400 grams to 17,480 grams and the cross-machine direction stiffness was reduced from 297,400 grams to 15,230 grams. Similarly, the machine direction tensile energy absorption (TEA) was reduced from 1146 centimeters-grams force to 250 centimeters-grams force and the cross-machine direction TEA was reduced from 1562 centimeters-grams force to 264 centimeters-grams force.

It will be appreciated that the foregoing discussion and examples, given for purposes of illustration, are not to be construed as limiting the scope of this invention, which is defined by the following claims and all equivalents thereto.

We claim:

1. A method of softening a wet-pressed, creped tissue sheet comprising passing the wet-pressed, creped tissue sheet through one or more noncompactive, fixed-gap straining nips, each nip formed between two engraved rolls having partially-engaged intermeshing straining elements which noncompactively strain the tissue sheet in all directions, wherein the Average Percent Void Area of the tissue sheet is increased about 1.5 percentage points or greater per 100 grams of geometric mean tensile strength loss without an increase in the external bulk of the tissue sheet.

2. The method of claim 1 wherein the Average Percent Void Area of the resulting tissue sheet is about 63 or greater.

3. The method of claim 1 wherein the number of straining nips is two or more.

4. The method of claim 3 wherein at least two straining nips have different degrees of engagement.

5. The method of claim 3 wherein at least two straining nips have different straining elements.

6. The method of claim 3 wherein the degree of engagement of the straining elements in a succeeding straining nip is less than the degree of engagement of the straining elements in the preceding straining nip.

7. The method of claim 3 wherein the degree of engagement of the straining elements in a succeeding straining nip is about the same as the degree of engagement of the straining elements in the preceding straining nip.

8. The method of claim 3 wherein the degree of engagement of the straining elements in a succeeding straining nip is greater than the degree of engagement of the straining elements in the preceding straining nip.

9. The method of claim 1 wherein the number of straining nips is three or more.

10. The method of claim 1 wherein the number of straining nips is six or more.

11. The method of claim 1 wherein the straining elements have a round shape as viewed perpendicular to the surface of the straining roll.

12. The method of claim 1 wherein the straining elements have an oblong shape as viewed perpendicular to the surface of the straining roll.

13. The method of claim 1 wherein the number of straining elements per unit length in the circumferential direction of the straining rolls is greater than the number of straining elements per unit length in the axial direction of the straining rolls.

14. The method of claim 1 wherein the number of straining elements per unit length in the circumferential direction of the straining rolls is less than the number of straining elements per unit length in the axial direction of the straining rolls.

15. The method of claim 1 wherein the number of straining elements per unit length in the circumferential direction of the straining rolls is equal to the number of straining elements per unit length in axial direction of the straining rolls.

16. The method of claim 1 wherein the increase in the Average Percent Void Area of the tissue sheet is about 2 percentage points or greater per 100 grams of geometric mean tensile strength loss.

17. The method of claim 1 wherein the increase in the Average Percent Void Area of the tissue sheet is about 3 percentage points or greater per 100 grams of geometric mean tensile strength loss.

* * * * *